United States Patent [19]

Kolton et al.

[11] Patent Number: 5,074,447

[45] Date of Patent: Dec. 24, 1991

[54] HIGH DENSITY DISPLAY HANGER WITH HOOK STABILIZER AND OPEN HOOK

[75] Inventors: Chester Kolton, Westfield; Stuart S. Spater, Livingston, both of N.J.

[73] Assignee: A & E Products Group, a division of Carlisle Plastics, Inc., Woodbridge, N.J.

[21] Appl. No.: 580,951

[22] Filed: Sep. 11, 1990

[51] Int. Cl.[5] ..... A47G 25/48; A47G 25/14

[52] U.S. Cl. ..... 223/96; 223/85; 223/95; 223/DIG. 1; 223/91

[58] Field of Search ..... 223/85, 95, 92, 87, 223/88, DIG. 1, 90, 91, 93, 96; D6/315, 328; 211/113

[56] References Cited

U.S. PATENT DOCUMENTS

| | | | |
|---|---|---|---|
| 2,696,936 | 12/1954 | Soldan | 223/95 |
| 3,329,386 | 7/1967 | Rosen | 223/87 X |
| 3,790,045 | 2/1974 | Rigel et al. | 223/87 |
| 3,837,544 | 9/1974 | Greenwald | 223/87 |
| 3,841,478 | 10/1974 | Wells et al. | 223/87 X |
| 4,623,079 | 11/1986 | Tendrup et al. | 223/85 |
| 4,828,155 | 5/1989 | Louw | 223/85 |

FOREIGN PATENT DOCUMENTS

| | | | |
|---|---|---|---|
| 235379 | 9/1961 | Australia | 223/88 |
| 7601823 | 9/1977 | France | 223/85 |
| 7826726 | 9/1978 | France | 223/85 |

*Primary Examiner*—Werner H. Schroeder
*Assistant Examiner*—Bibhu Mohanty
*Attorney, Agent, or Firm*—Blum Kaplan

[57] ABSTRACT

A hanger comprised of an integral body of molded synthetic material defines a hook portion having an interior detent for the receipt of a display rod and an elongate channel open exteriorly of the hanger body and extending into communication with the detent, the detent being of cross-sectional dimension exceeding the cross-sectional dimension of the channel, the hanger being adapted to retentively, releasably contain the display rod on insertion thereof through the channel into the detent by imposing generally radially directed force onto the display rod. The hanger body includes a central portion with an extension thereabove and a transversely extending member cantilever-supported by the extension, the transversely extending member having an exterior surface bounding the channel and the detent.

10 Claims, 3 Drawing Sheets

HIGH DENSITY DISPLAY HANGER WITH HOOK STABILIZER AND OPEN HOOK

FIELD OF THE INVENTION

This invention relates generally to hangers for the display of garments and pertains more particularly garment hangers which effect high density display of garments, i.e., wherein an increased number of hangers can be used than would otherwise be the case.

BACKGROUND OF THE INVENTION

In the marketing of garments, such as ladies' panties and bras, forms of hangers are known, such as are shown in U.S. Pat. No. 4,623,079 and U.S. Pat. No. 4,828,155, of the type having a hook portion elevated above a body portion, the hanger having the facility for hanging either or both of the panties and bra. The hook portions of such hangers are applied to a cylindrical rod type of display rod and the diameter of the display rod and the vertical extent of the hanger hook portion thus occupy a number of vertical inches of display space, limiting the number of garments for display in the vertical direction. Evidently, the garment industry has desire for maximizing display density.

As a further consideration of the limitations of the prior art, applicants note that the prior art, elevated hook portion types of hangers are readily and unintentionally removable from the display rod, being simply gravity-dependent thereon.

SUMMARY OF THE INVENTION

It is a primary object of this invention to satisfy the above-posited garment industry desire in enhancing display density.

A more particular object of the present invention is to lessen display rod and hanger hook space in the display of such garments as panties and bras.

It is a further object of the invention to provide for enhanced retention of garment hangers with display rods.

In the attainment of these and other objects, the invention provides a hanger with a hook portion of lessened vertical elevation above its body portion than heretofore obtaining, such hook portion having facility for sideward receipt of a display rod and self-biased retention thereof.

More particularly, the hook portion of a hanger constructed in accordance with the invention is configured with an elongate upper transverse part which is cantilever-supported at one end thereof by an extension of the hanger body portion and extends to a free end. The hanger defines a transverse channel bounded by the upper transverse part and the hanger body, the upper transverse part defining, in its undersurface, a detent for biased engagement with the display rod.

The foregoing and other features of the invention will be further understood from the following detailed description of a preferred embodiment thereof and from the drawings wherein like reference numerals identify like components and parts throughout.

DETAILED DESCRIPTION OF THE PREFERRED EMBODIMENT

Figure 4:
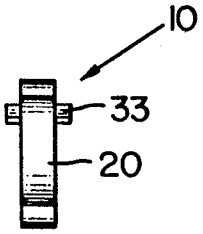
FIG. 4 is right side elevation of the FIG. 1 hanger.

Referring to FIGS. 1–4, hanger 10 is comprised of an integral body of molded synthetic material, having a central portion 12 and sideward portions 14 and 16 extending respectively leftwardly and rightwardly of central portion 12 and defining bra hanging extremities 18 and 20. The configuration of the extremities 18 and 20 is illustrative and does not form a part of the subject invention. Other known extremity configurations, akin to those shown in above-reference prior art patents, and inclusive of facility for panty hanging, may evidently be used.

Hanger central portion 12 includes a logo/size display part 22 and an extension 24 projecting vertically above display part 22 and supporting an elongate upper hanger transverse part 26, which is cantilever-supported at one end **26*a* thereof by extension 24, transverse part 26 extending to a free end 26*b***.

Figure 2:
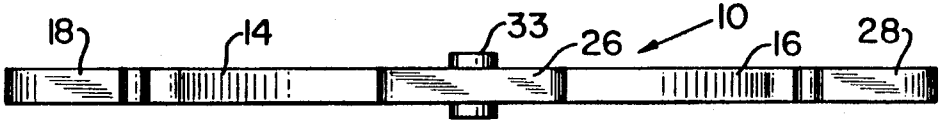
FIG. 2 is a top plan elevation of the FIG. 1 hanger.
Figure 1:
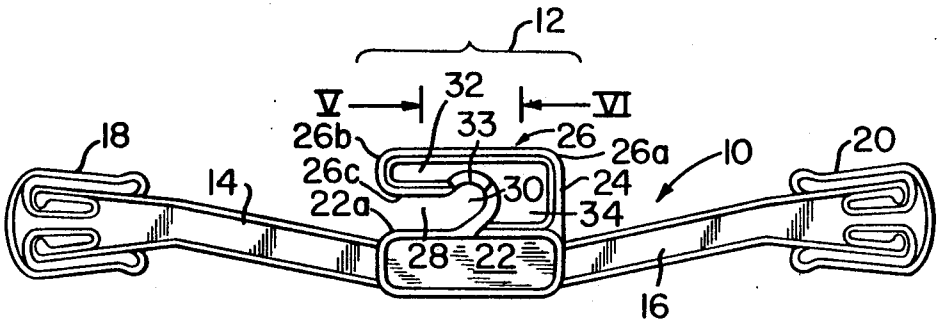
FIG. 1 is a front elevation of a hanger configured in accordance with the invention.
Figure 3:
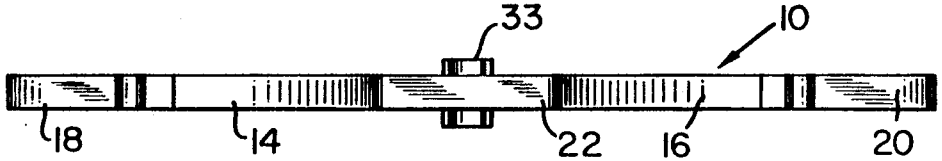
FIG. 3 is a bottom plan elevation of the FIG. 1 hanger.

Hanger 10 defines a transverse channel 28 bounded by undersurface **26*c* of transverse part 26 and upper surface 22*a* of display part 22, these surfaces being contiguous and merging interiorly of channel 28 to form a circular hanger rod detent 30. A stabilizer member 33 extends bidirectionally of hanger 10, as is best seen in FIGS. 2–4. The stabilizer member is effective to assure parallelism of hanger 10** with the longitudinal axis of a display rod disposed in the detent.

Figure 7:
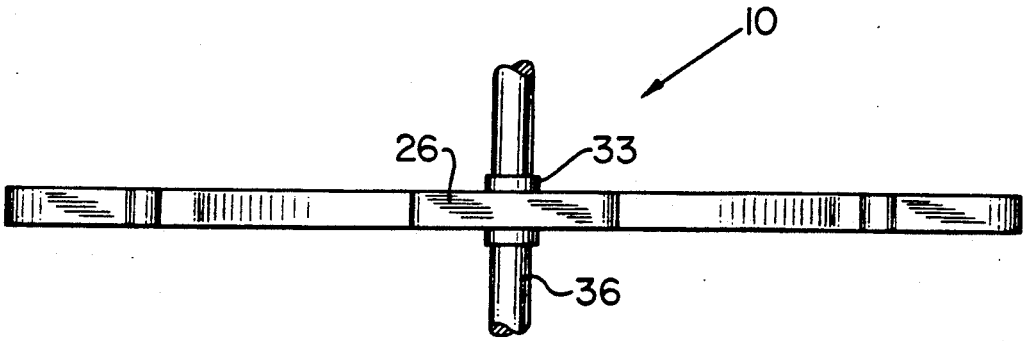
FIGS. 7 and 8 are respective front and top plan elevations of the FIG. 1 hanger in assembly with a display rod.
Figure 8:
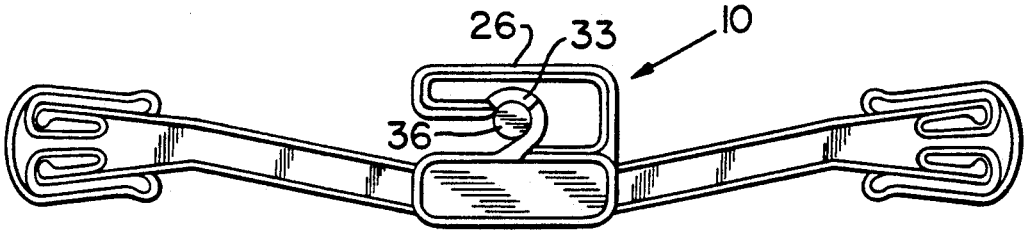

In the preferred embodiment of the invention, hanger 10 is configured with open, non-plastic areas 32 and 34 aside detent 30 for the purpose of permitting upper part 26 to have enhanced ability to be displaced by display rod 36 (FIG. 7), which has entry into detent 30 through channel 28, the channel being of somewhat less cross-sectional dimension than the diameter of display rod 36 and detent 30 having dimension substantially equal to the diameter of the display rod. In such preferred embodiment, practice is to effect movement of the display rod into the channel, which gives rise to pivoting of transverse part 26 about its end **26*a* attached to projection 24 to an extent permitting residence of display rod 36 in detent 30, and reverse, self-biased movement of transverse part 26 onto the inserted display rod to releasably ensnare the same, exerting generally radially directed forces onto the display rod. Evidently, hanger 10 may be removed from display rod 36** by forcible relative movement of such components, but there is clearly an enhanced retention of the components above and beyond the simple, gravity-based retention thereof in the prior art arrangements above discussed.

Figure 5:
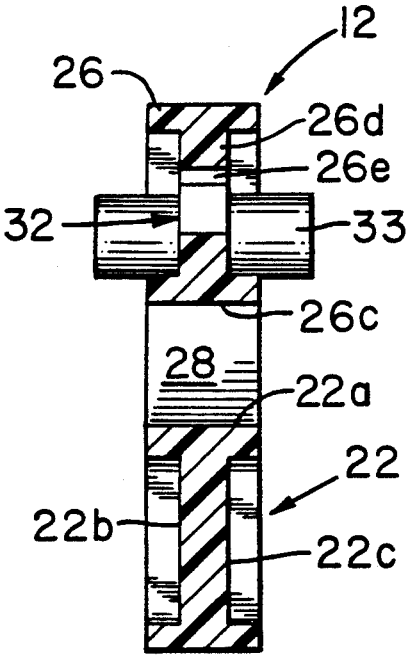
FIG. 5 is a sectional view of the FIG. 1 hanger as would be seen from plane V—V of FIG. 1.
Figure 6:
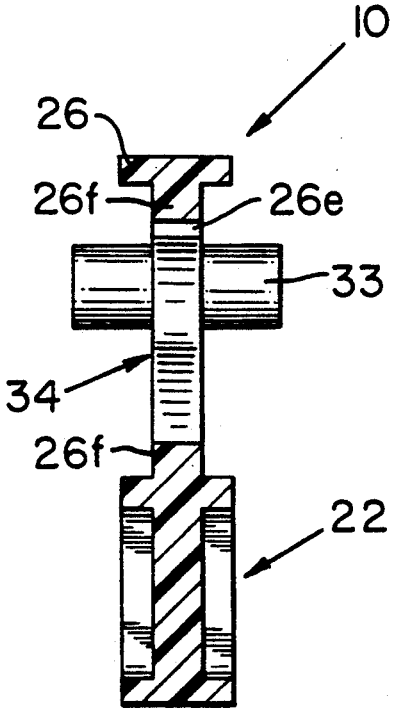
FIG. 6 is a sectional view of the FIG. 1 hanger as would be seen from plane VI—VI of FIG. 1.

Further structural details of hanger central part 12 will be seen by reference to the sectional showings of FIGS. 5 and 6. In FIG. 5, transverse member 26 has a reduced thickness projection **26*d* extending in bounding relation to open area 32 and includes interiormost courses atop stabilizer 33 and forming an end part 26*e*, which renders stabilizer 33 and transverse member 26** integral centrally of the hanger. Display part 22 will be seen to have planar, recessed surfaces 22*b* and 22*c* for logo or size imprinting. In FIG. 6, transverse member 26 will be seen to have a further reduced thickness projection 26*f* extending in bounding relation to open area 34 and includes interiormost courses atop stabilizer 32 and forming such end part 26*e*.

By way of summary of the invention, and introduction to the ensuing claims in respect thereof, the invention provides a hanger comprised of an integral body of molded synthetic material and defining a hook portion having an interior detent for the receipt of a display rod and an elongate channel open exteriorly of the hanger body and extending into communication with the detent, the detent being of cross-sectional dimension exceeding the cross-sectional dimension of the channel, the hanger being adapted to retentively, releasably contain the display rod on insertion thereof through the channel into the detent by imposing generally radially directed force onto the display rod. The body includes a central portion with an extension thereabove and a transversely extending member cantilever-supported by the extension, the transversely extending member having an exterior surface bounding the channel. The exterior surface of the transversely extending member further bounds the detent. The body central portion includes a part downwardly of the extension and the transversely extending member, such downward part having an exterior surface bounding the channel. The body downward part exterior surface further bounds the detent contiguously with the transversely extending member. The body further defines a stabilizer member in registry with the detent and projecting bidirectionally outwardly of the body. The transversely extending member defines an open area aside the detent and interiorly of the exterior surface thereof, which open area includes two separate portions respectively oppositely aside the detent.

Various changes to the depicted structure and modifications in practice may be introduced without departing from the invention. Thus, as noted, the configuration of the bra supporting outward portions of the hanger may be other than as particularly illustrated. Indeed, the hanger may evidently be employed for the hanging of other garments. Accordingly, it is to be understood that the particularly depicted and described embodiment and the specifically discussed practices are intended in an illustrative and not in a limiting sense. The true spirit and scope of the invention is set forth in the appended claims.

We claim:

1. A hanger comprised of an integral body of molded synthetic material and defining a hook portion having an interior detent for the receipt of a display rod and an elongate channel open exteriorly of said hanger body and extending into communication with said detent, said detent being of cross-sectional dimension exceeding the cross-sectional dimension of said channel, said hanger being adapted to retentively, releasably contain said display rod on insertion thereof through said channel into said detent, said body defining stabilizer means in registry with said detent and projecting bidirectionally outwardly of said body.

2. The invention claimed in claim 1 wherein said body includes a central portion with an extension thereabove and a transversely extending member cantilever-supported by said extension, said transversely extending member having an exterior surface bounding said channel.

3. The invention claimed in claim 2 wherein said exterior surface of said transversely extending member further bounds said detent.

4. The invention claimed in claim 3 wherein said body central portion includes a part downwardly of said extension and said transversely extending member, such downward part having an exterior surface bounding said channel.

5. The invention claimed in claim 4 wherein said body downward part exterior surface further bounds said detent contiguously with said transversely extending member.

6. A hanger comprised of an integral body of molded synthetic material and defining a hook portion having an interior detent for the receipt of a display rod and an elongate channel open exteriorly of said hanger body and extending into communication with said detent, said detent being of cross-sectional dimension exceeding the cross-sectional dimension of said channel, said hanger being adapted to retentively, releasably contain said display rod on insertion thereof through said channel into said detent, said body including a central portion with an extension thereabove and a transversely extending member supported by said extension, said transversely extending member having an exterior surface bounding said channel and defining an interior open area extending with said exterior surface over said channel.

7. The invention claimed in claim 6 wherein said exterior surface of said transversely extending member further bounds said detent.

8. The invention claimed in claim 7 wherein said transversely extending member includes a further interior open area extending with said exterior surface about said detent.

9. The invention claimed in claim 8 wherein said body further defines a stabilizer member in registry with said detent and projecting outwardly of said body.

10. The invention claimed in claim 9 wherein said stabilizer member projects bidirectionally outwardly of said body.

* * * * *